US008186541B2

(12) United States Patent
Szymonski et al.

(10) Patent No.: US 8,186,541 B2
(45) Date of Patent: May 29, 2012

(54) TISSUE SHEET DISPENSER AND PROCESS FOR MAKING SAME

(75) Inventors: Krzysztof Andrzej Szymonski, Neenah, WI (US); Daphne Lynn VanBuren, Greenville, WI (US); Sara Marie Etheridge, Menasha, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1223 days.

(21) Appl. No.: 11/216,468

(22) Filed: Aug. 31, 2005

(65) Prior Publication Data

US 2007/0045335 A1 Mar. 1, 2007

(51) Int. Cl.
*A47K 10/24* (2006.01)
*B65H 1/00* (2006.01)

(52) U.S. Cl. ..... 221/50; 221/48; 221/302; 221/47; 221/68; 221/34; 221/32; 221/63; 221/53; 221/37; 221/210; 221/33; 221/45; 206/233; 206/494; 206/460

(58) Field of Classification Search ..... 221/48, 221/302, 47, 68, 34, 32, 63, 50, 37, 210, 221/33, 45; 206/233, 494, 460
See application file for complete search history.

(56) References Cited

U.S. PATENT DOCUMENTS

| | | | | |
|---|---|---|---|---|
| 2,071,981 | A * | 2/1937 | Landsiedel | 221/37 |
| 2,269,039 | A | 1/1942 | Ross | |
| 2,269,525 | A * | 1/1942 | Fleischer | 221/33 |
| 2,284,071 | A * | 5/1942 | Sayles | 221/37 |
| 2,885,112 | A * | 5/1959 | Willat | 221/33 |
| 3,276,622 | A * | 10/1966 | Krzyzanowski | 221/37 |
| 3,691,140 | A | 9/1972 | Silver | |
| 3,841,466 | A | 10/1974 | Hoffman et al. | |
| 3,857,731 | A | 12/1974 | Merrill, Jr. et al. | |
| 3,868,052 | A | 2/1975 | Rockefeller | |
| 3,979,019 | A | 9/1976 | Bliss | |
| 4,138,034 | A | 2/1979 | McCarthy | |

(Continued)

FOREIGN PATENT DOCUMENTS

DE 20 2004 007773 U1 7/2004

(Continued)

OTHER PUBLICATIONS

PCT Search Report and Written Opinion for PCT/US2006/021608, Oct. 16, 2006.

*Primary Examiner* — Gene O. Crawford
*Assistant Examiner* — Rakesh Kumar
(74) *Attorney, Agent, or Firm* — Dority & Manning, P.A.

(57) ABSTRACT

A dispenser for dispensing interfolded disposable sheets is disclosed. The dispenser includes a removable panel that is attached to the first sheet in the stack contained in the container. When the removable panel is pulled off the container, the first sheet in the stack is partially or completely withdrawn from the container. The removable panel may be adhered to the first sheet using an adhesive material. The adhesive material may be contained in a recess formed in the removable panel. The recess is designed to protect the adhesive material during manufacture of the product and/or to prevent the adhesive material to adhering to other portions of the product. In one embodiment, after the stack of sheets are loaded into the dispenser, the recess is inverted forming a protrusion that contacts the first sheet in the stack and forms a bond between the removable panel and the first sheet.

30 Claims, 4 Drawing Sheets

U.S. PATENT DOCUMENTS

| | | | | | |
|---|---|---|---|---|---|
| 4,166,152 | A | | 8/1979 | Baker et al. | |
| 4,197,964 | A | | 4/1980 | Pryor | |
| 4,221,304 | A | | 9/1980 | Wahl et al. | |
| 4,231,491 | A | | 11/1980 | Pierson et al. | |
| 4,417,670 | A | * | 11/1983 | Booher | 221/210 |
| 4,574,952 | A | * | 3/1986 | Masui | 206/494 |
| 4,681,240 | A | * | 7/1987 | Wyant | 221/48 |
| 4,739,902 | A | * | 4/1988 | Joslyn et al. | 221/37 |
| 4,786,696 | A | | 11/1988 | Bohnel | |
| 4,805,801 | A | * | 2/1989 | Knopf | 221/210 |
| 4,870,725 | A | * | 10/1989 | Dubowik | 24/442 |
| 4,988,567 | A | | 1/1991 | Delgado | |
| 4,994,322 | A | | 2/1991 | Delgado et al. | |
| 5,045,569 | A | | 9/1991 | Delgado | |
| 5,046,640 | A | * | 9/1991 | Carroll | 221/213 |
| 5,097,984 | A | * | 3/1992 | Meisner et al. | 221/37 |
| 5,197,630 | A | * | 3/1993 | Kirla | 221/37 |
| 5,518,144 | A | * | 5/1996 | Samuelson et al. | 221/33 |
| 5,542,568 | A | | 8/1996 | Julius | |
| 5,939,161 | A | * | 8/1999 | Callahan et al. | 428/40.1 |
| 5,964,341 | A | | 10/1999 | Tsai | |
| 5,964,351 | A | | 10/1999 | Zander | |
| 5,992,682 | A | | 11/1999 | Loppnow et al. | |
| 6,045,002 | A | | 4/2000 | Wierschke | |
| 6,068,583 | A | * | 5/2000 | Sigl | 493/60 |
| 6,082,581 | A | * | 7/2000 | Anderson et al. | 221/232 |
| 6,109,430 | A | | 8/2000 | Bando et al. | |
| 6,202,845 | B1 | | 3/2001 | Hill | |
| 6,268,032 | B1 | | 7/2001 | Mertens et al. | |
| 6,273,293 | B1 | * | 8/2001 | Carlson | 221/37 |
| 6,419,114 | B1 | | 7/2002 | Lenz et al. | |
| 6,478,188 | B1 | * | 11/2002 | Fay | 221/210 |
| 6,550,634 | B1 | | 4/2003 | Alegre De Miquel et al. | |
| 6,715,633 | B2 | | 4/2004 | Thoms | |
| 2003/0062376 | A1 | | 4/2003 | Sears et al. | |
| 2003/0106900 | A1 | * | 6/2003 | Storz | 221/259 |

FOREIGN PATENT DOCUMENTS

| | | | |
|---|---|---|---|
| WO | WO 9617794 | A1 | 6/1996 |
| WO | WO 0061458 | A1 | 10/2000 |
| WO | WO 03024842 | A1 | 3/2003 |

* cited by examiner

TISSUE SHEET DISPENSER AND PROCESS FOR MAKING SAME

BACKGROUND OF THE INVENTION

Disposable sheet style dispensers are well-known in the art for dispensing individual folded sheet products such as facial tissues, hand sheets, wet wipes, or the like. In general, disposable sheet dispensers typically include a container and a stack or clip of pre-folded, interfolded sheets disposed within the container. The sheets may be C-folded, V-folded, Z-folded, tab-bonded or flat so that once the top sheet in the clip is withdrawn, the underlying sheet is individually presented for subsequent use.

One of the common problems among disposable sheet dispensers involves the issue of "double pull". This occurs when more than one sheet comes out of the container when the leading sheet is withdrawn. Additionally, the problem of "streaming" can occur in disposable sheet dispensers. Streaming occurs when the user pulls the first sheet out, and subsequent sheets are also withdrawn, with the separation of the following ones never occurring.

To overcome some of these problems, disposable sheet dispensers have been designed where the dispensing slot is covered by a plastic film defining a slit. The use of slits has worked well in eliminating some of the above problems. Narrow slits are also well-suited to presenting tissue sheets for subsequent removal. In some applications, however, it is sometimes difficult to remove the initial sheet from the stack when a slit is present. For instance, the slit can interfere with the ability of a user to grab the leading edge.

In order to overcome some of these problems, in U.S. Pat. No. 4,574,952 to Masui, which is incorporated herein by reference, a box containing facial tissues is disclosed in which a tape or strings are attached to the undersurface of a removable panel of the box and, in turn, attached to the upper most of the facial tissues. In this manner, when the box is opened, and the removable panel is removed along a perforated line, the upper most facial tissue is automatically removed from the container along with the removable panel.

In U.S. Pat. No. 6,715,633 to Thoms, which is also incorporated herein by reference, a dispenser for dispensing a stack of disposable sheets is disclosed having a removable panel that is releasably attached to the first sheet in the stack. When the removable panel is pulled off the container, the first sheet in the stack is partially withdrawn from the container. After being partially withdrawn, however, the sheet releases from the removable panel.

Although the above two patents, especially the '633 patent, have provided advancements in the art, further improvements are still needed. In particular, a need exists for an attachment mechanism for use in either of the above disclosed dispensers for attaching the first sheet in a stack of disposable sheets to a removable panel. More particularly, a need exists for a method of attaching a tissue sheet to a removable panel of a dispenser using an adhesive without the adhesive interfering with the production of the dispenser and the loading of the stack of disposable sheets into the dispenser.

SUMMARY OF THE INVENTION

In general, the present disclosure is directed to a dispenser for dispensing interfolded disposable sheets. A stack of interfolded disposable sheets are housed within a container. The sheets are arranged to be withdrawn from the container one after another. The sheets can be various paper products, including facial tissues, paper towels, industrial wipers, laboratory wipers, wet wipes, and the like. The dispensing container includes a removable panel that, once removed, uncovers an opening for withdrawing the sheets.

The removable panel is attached to a first sheet in the stack of interfolded sheets. In particular, the removable panel is attached to the first sheet such that when the removable panel is removed from the dispensing container, the first sheet is either partially pulled through the opening of the dispensing container and released from the removable panel or is completely withdrawn from the dispensing container when the panel is removed.

In accordance with the present disclosure, the removable panel is attached to the first sheet in the stack of interfolded sheets by an adhesive material. In order to apply the adhesive material between the removable panel and the first sheet in the stack of interfolded sheets without the adhesive interfering with the manufacturing process, the removable panel defines an adhesive receptive portion. The adhesive receptive portion defines a recess where the adhesive material is located. By being placed in the recess, the adhesive material is prevented from adhering to other portions of the dispensing container or other portions of the interfolded sheets.

Once the stack of interfolded sheets is loaded into the dispensing container, the adhesive is then contacted with the first sheet in the stack of interfolded sheets. For example, in one embodiment, the adhesive material may be contacted with the first sheet in the stack by applying a pressure to an outside surface of the removable panel. The outside pressure may cause the recess to invert and form a protrusion for contact with the first sheet.

Alternatively, the adhesive material may be contacted with the first sheet in the stack of interfolded sheets by inverting the dispensing container once the interfolded sheets have been loaded into the container. By inverting the dispensing container, the stack of interfolded sheets applies sufficient pressure to cause a contact between the first sheet and the adhesive material contained in the recess.

The recess (or protrusion after the recess is inverted) may have any suitable dimensions capable of protecting the adhesive material during manufacture of the product. For example, in one embodiment, the recess may have a depth of from about 0.05 inches to about 0.25 inches. The effective diameter of the recess is generally not critical as long as the recess can be located on the removable panel. In one embodiment, for example, the recess may have an effective diameter of up to about 2 inches, such as from about 0.125 inches to about 0.5 inches. The recess can have any suitable shape. As used herein, the effective diameter of the recess refers to a diameter of a circle that corresponds to the surface area of the recess.

The recess may also be formed in the removable panel using any suitable technique. For instance, the recess may be formed using a mechanical punch or may be embossed into the removable panel. In one embodiment, the recess may have the shape of a tradename, a logo, or other suitable design.

The adhesive material may comprise any suitable adhesive capable of adhering the removable panel to one of the sheets in the stack. The adhesive material, for instance, may comprise a hotmelt adhesive or a pressure sensitive adhesive. In general, the adhesive is present within the recess in relatively small amounts. For example, in one particular embodiment, the adhesive material may be present in the recess in an amount less than about 0.5 grams.

The dispensing container can be made from various materials and is generally not critical to the present invention. For instance, the dispensing container can be made from paperboard or from a flexible polymer film. The dispensing container can be in the shape of a rectangular box, a square box, or in the form of any other suitable shape.

Other features and aspects of the present invention are discussed in greater detail below.

BRIEF DESCRIPTION OF THE DRAWINGS

An embodiment of the present invention is described by way of example with reference to the accompanying drawings, in which.

Figure 1:
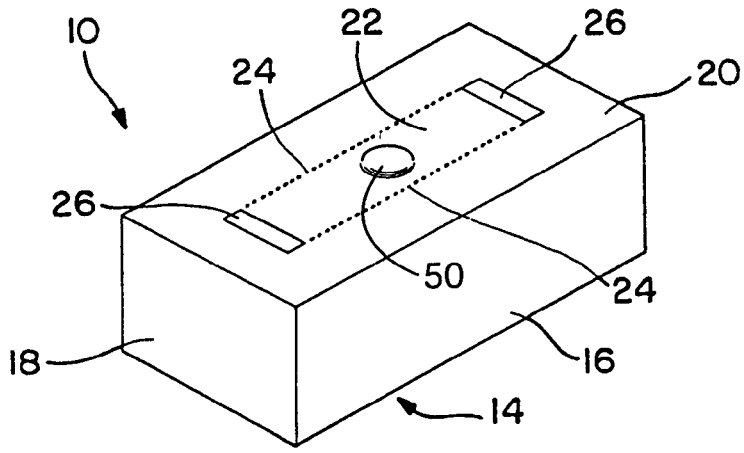
FIG. 1 is a perspective view of one embodiment of a dispenser made in accordance with the present disclosure.

Repeat use of reference characters in this present specification and drawings is intended to represent same or analogous features or elements.

DETAILED DESCRIPTION

Reference will now be made in detail to embodiments of the invention, one or more examples of which are illustrated in the drawings. Each example is provided by way of explanation of the invention, and is not meant as a limitation of the invention. For example, features illustrated or described as part of one embodiment can be used with another embodiment to yield still a third embodiment. It is intended that the present invention includes these and other modifications and variations.

In general, the present disclosure is directed to a dispenser for dispensing interfolded disposable sheets. The disposable sheets can be, for instance, facial tissues, paper towels, industrial wipers, laboratory wipers, wet wipes, and the like. The dispensing container includes a removable panel that, once removed, uncovers an opening for withdrawing the sheets. The removable panel is attached to the first sheet in the stack contained within the dispensing container.

Specifically, the removable panel is attached to the first sheet in the stack by an adhesive material. The adhesive material is applied to the removable panel so that the adhesive material is available for attachment to the first sheet in the stack of disposable sheets but does not otherwise interfere with the process of constructing the dispenser and filling the dispenser with the stack of sheets. For example, in one embodiment, a recess is formed in the removable panel. The adhesive material is then placed in the recess. By placing the adhesive material in the recess, the adhesive material does not contact other portions of the dispenser or other dispensers during manufacture. Once the stack of disposable sheets is then loaded into the dispenser, the adhesive material is contacted with a first sheet in the stack. For example, in one embodiment, pressure is placed on the removable panel causing the recess to invert and form a protrusion into an interior volume of the dispenser. The adhesive material is located on the protrusion for contact with the first sheet in the stack of disposable sheets. Thus, a bond is made between the removable panel and the first sheet.

Depending upon the particular application and the desired result, the adhesive material may securely affix the removable panel to the first sheet in the stack of disposable sheets or may be releasably attached to the first sheet. For example, in one embodiment, the removable panel is attached to the first sheet in a manner such that when the panel is removed from the dispensing container, the first sheet is partially withdrawn. Once the sheet is partially withdrawn, the first sheet then detaches from the removable panel. Thus, once the panel is removed from the container, the first sheet in the stack is available for easy and immediate removal.

In an alternative embodiment, however, the removable panel may be more securely affixed to the first sheet in the stack of disposable sheets. In this embodiment, for example, the first sheet is completely withdrawn from the dispensing container when the removable panel is removed.

Referring to the figures, one embodiment of a dispensing container generally 10 is shown made in accordance with the present disclosure. The dispensing container 10 is for housing facial tissue in accordance with one embodiment. It should be understood, however, that various other interfolded disposable sheets can be contained in the container.

Figure 9:
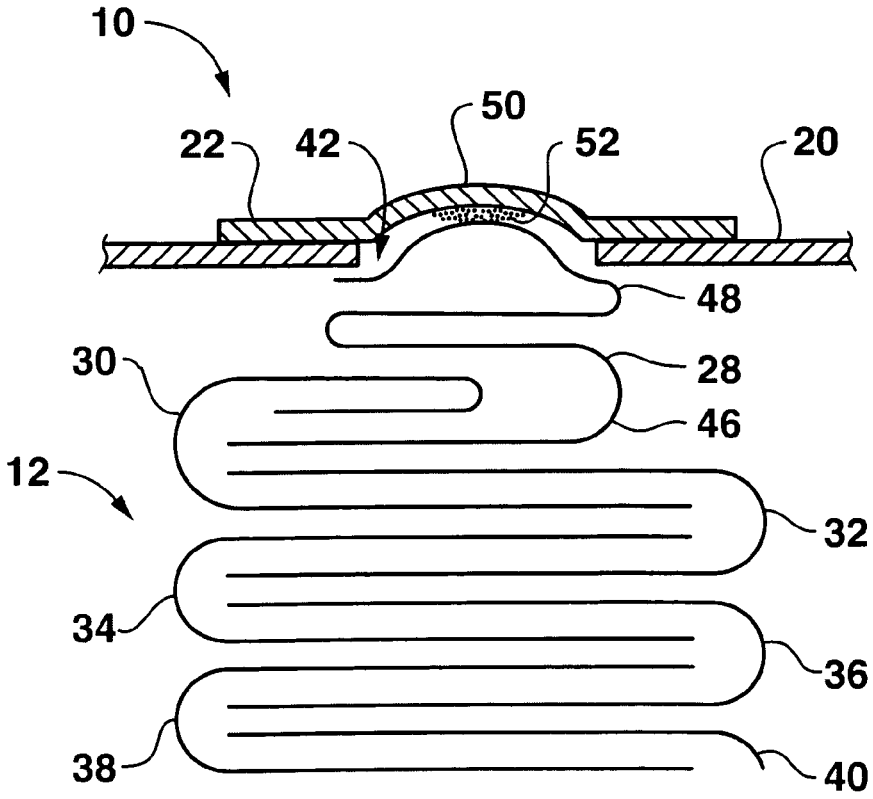
FIG. 9 is a cross-sectioned diagrammatical view of another embodiment of a dispenser made in accordance with the present disclosure.

Referring to FIG. 1 and FIG. 9, dispensing container 10 contains a clip of interfolded disposable sheets. The clip of interfolded disposable sheets 12 as shown particularly in FIG. 9 may be C-folded, V-folded, Z-folded, tab-bonded or configured with respect to one another by any means commonly known in the art.

As shown in FIG. 1, the dispensing container 10 includes a pair of sides or walls 16 that are contiguous with another pair of sides or walls 18. A support side or bottom wall 14 is present and is in contact with the walls 16 and 18. The interfolded sheets contained within the container generally rest upon the bottom wall 14 in this embodiment.

Figure 2:
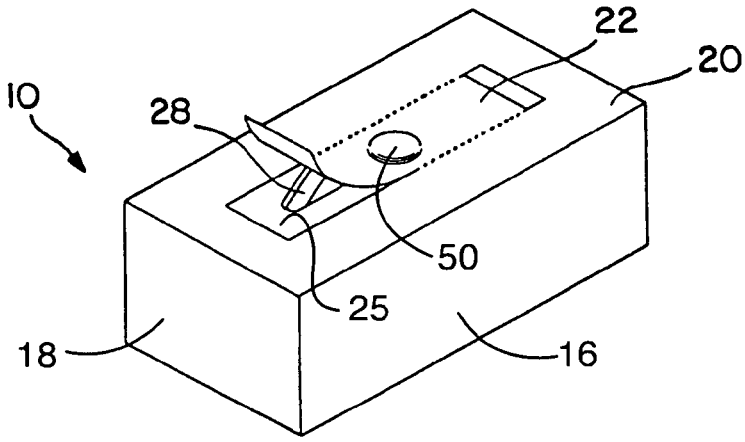
FIG. 2 is a perspective view of the dispenser illustrated in FIG. 1 showing the dispenser partially opened.
Figure 3:
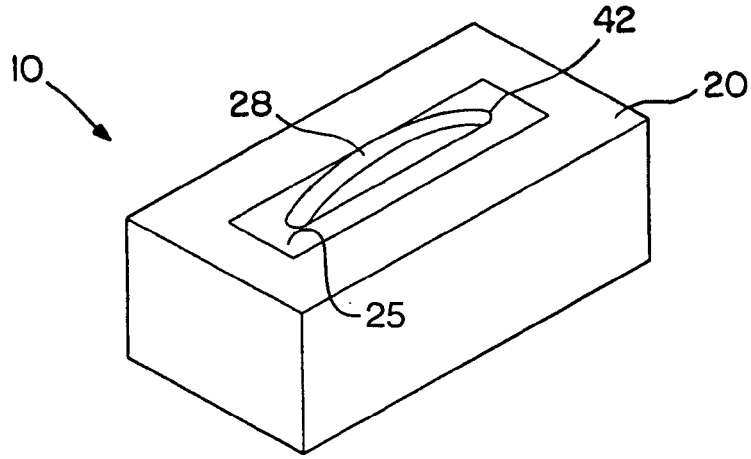
FIG. 3 is a perspective view of the dispenser illustrated in FIG. 1 showing the removable panel of the dispenser removed exposing a sheet of material available to be withdrawn.

Also contiguous with the walls 16 and 18 is a dispensing wall or top wall 20. The top wall 20 includes a removable panel 22. The removable panel 22 may include an end extension, such as a pair of end extensions 26 as shown in the figure that are separated by lateral perforations 24. In this manner, a user is able to grasp either of the end extensions 26 and pull the panel along the perforations 24. In one embodiment, as shown in FIGS. 1-3, once the removable panel 22 is removed from the dispensing container, a polymer film 25 is exposed. The polymer film 25 includes an opening, such as a slit, that facilitates dispensing the sheets one at a time.

In general, the dispensing container 10 can be made from various materials. For instance, the container can be made from paperboard or cardboard. Alternatively, the container can be made from plastic films, such as thermoplastic films. Materials used to form the walls of the container can be rigid or flexible.

Referring to FIG. 9, a simplified cross-sectional view of the dispensing container 10 is shown. As illustrated, the container 10 includes the top wall 20 and the removable panel 22. In this embodiment, as opposed to the embodiment illustrated in FIG. 1, the removable panel 22 overlaps the top wall 20 and is not attached to the top wall via perforations. Instead, in this embodiment, the removable panel 22 can be removably adhered to the top wall.

As shown, below the top wall 20 is a stack of interfolded sheets generally 12. For purposes of illustration only, 7 interfolded sheets are illustrated, namely sheets 28, 30, 32, 34, 36, 38 and 40. The sheets are interfolded together and separated in the drawing for ease of explanation. The first sheet 28 as shown in the figure is folded upon itself two times at the top to facilitate removal of the sheet. It should be understood, however, that more or less folds in the top sheet may be present prior to withdrawing the sheet from the dispensing container.

The removable panel 22 is positioned over an opening 42 in the top wall 20. Opening 42 is for withdrawing the sheets from the container after the removable panel 22 has been removed. As shown, the first sheet 28 is attached to the removable panel 22 by an adhesive material 52. In accordance with the present disclosure, the adhesive material 52 is located within an adhesive receptive portion of the removable panel which, in this embodiment, comprises a recess 50.

The recess 50 is formed into the removable panel 22 in order to locate the adhesive material 52 in a protected area until contacted with the first sheet 28. More particularly, by forming the recess 50, the adhesive material 52 is prevented from contacting other portions of the dispensing container 10 or other portions of the stack of tissue sheets 12 during manufacture of the sheet product prior to contact with the first sheet 28.

Figure 4:
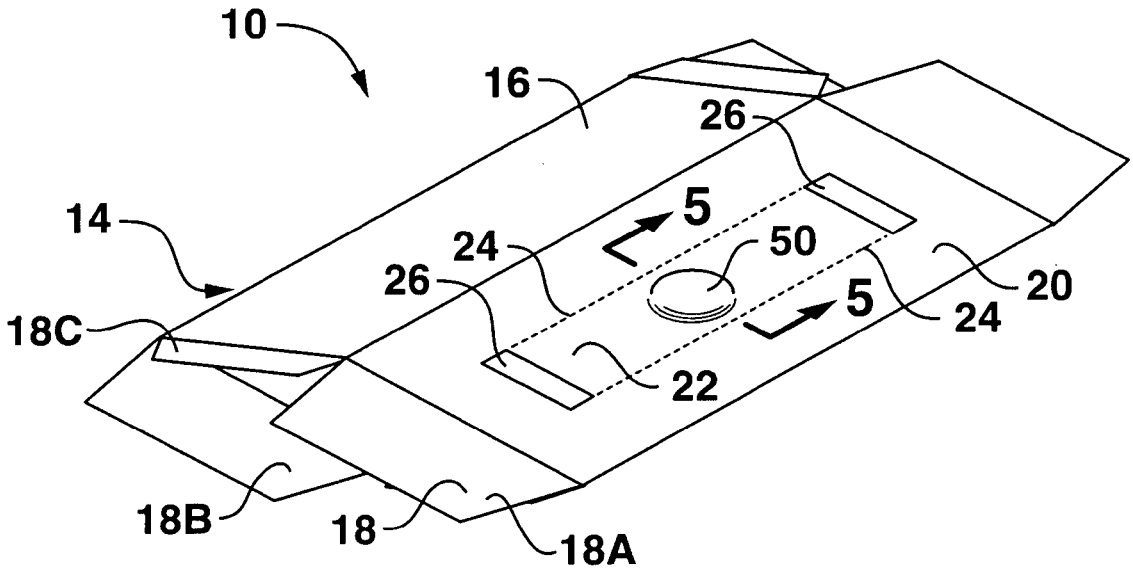
FIG. 4 is a perspective view of the dispensing container illustrated in FIG. 1 in a flat configuration prior to loading a stack of interfolded sheets into the container.

For example, in some applications, during the manufacture of the disposable sheet product, the dispensing container 10 is formed from a one-piece blank. The one-piece blank is then first assembled into a flat sleeve as shown in FIG. 4. The dispensing container 10 is placed initially in a flat sleeve configuration, for instance, prior to being loaded with the stack of disposable sheets so that the dispensing container can be stored and shipped more conveniently. In the flat sleeve configuration, at least two container walls are placed adjacent to one another.

For example, in the embodiment illustrated in FIG. 4, when the sleeve is laid flat, the top wall 20 lays adjacent to the side walls 16. The side walls 18, on the other hand, are comprised of a plurality of flaps that are later glued together after the plurality of tissue sheets are loaded into the container. As shown in FIG. 4, for instance, the side wall 18 comprises a plurality of flaps including flap 18A, flap 18B, and flap 18C.

Figure 5:
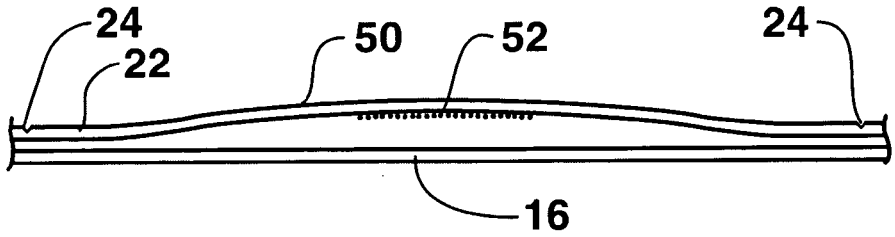
FIG. 5 is a cross-sectional view of one embodiment of a recess formed into a wall of a dispensing container for receiving an adhesive material.

For processing efficiencies, in one embodiment, the adhesive material that is used to attach the removable panel 22 to the first sheet in the stack of sheets is applied to the dispensing container 10 during production of the dispensing container and prior to loading the disposable sheets into the container. In order to prevent the adhesive material on the removable panel from adhering to other parts of the dispensing container 10, the removable panel 22 includes the recess 50 for receiving the adhesive material. The recess 50, for example, is more particularly shown in FIG. 5 when the dispensing container 10 is in a flat sleeve configuration. As illustrated, the removable panel 22 is shown placed adjacent to and in contact with the side wall 16. The recess 50, however, prevents the adhesive material 52 from also contacting and adhering or sticking to the side wall 16. More particularly, the recess 50 provides a protected location for the adhesive material 52 such that the adhesive material does not intersect a plane defined by the removable panel 22.

In addition to being used to protect an adhesive material when the dispensing container is in a flat sleeve configuration as shown in FIG. 4, the recess may also be used to protect the adhesive material when the dispensing container is in the form of a one-piece blank. In this embodiment, the recess may be used to prevent an adhesive material from sticking to an adjacent blank. The blanks, however, must be stacked together such that the recesses are not in alignment. For instance, the blanks may be rotated with respect to each other when the blanks are stacked together.

The dimensions of the recess 50 can vary depending upon the particular application and on various factors. For instance, the size of the recess 50 may depend upon the size of the removable panel 22, the particular adhesive material that is used, the materials used to form the dispensing container 10, and the like. For exemplary purposes, for instance, the recess 50 may have an effective diameter of less than about 2 inches, such as less than about 1 inch. In one particular embodiment, for example, the effective diameter of the recess 50 may be from about 0.125 inches to about 0.5 inches.

In other embodiments, it should be understood that the recess can be much larger than the dimensions supplied above. In one embodiment, for instance, the entire removable panel 22 may form the recess 50. For example, as shown in FIG. 9, in one embodiment the removable panel 24 rests on top of the top wall 20 instead of being integral with the top wall. In this embodiment, the removable panel 22 may be elevated sufficiently from the plane of the top wall so as to protect the adhesive as desired.

The depth of the recess 50 should be sufficient to protect the adhesive material 52. Thus, the depth of the recess 50 may depend upon the amount of adhesive material contained within the recess. For exemplary purposes, the depth of the recess 50 may be from about 0.01 inches to about 0.5 inches, such as from about 0.05 inches to about 0.25 inches.

In the embodiment illustrated in FIG. 4, the dispensing container 10 includes a single recess 50. It should also be understood, however, that the removable panel 22 may include a plurality of recesses if desired. A plurality of recesses may be included, for example, in order to bond the removable panel to a disposable sheet in more than one location.

Figure 6:
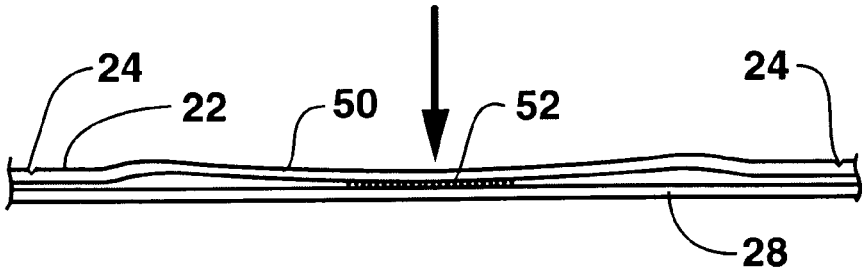
FIG. 6 is a cross-sectional view illustrating one embodiment of attachment of a wall of a dispensing container to a disposable sheet.

Once the adhesive material 52 is located within the recess 50, the first sheet 28 in the stack of disposable sheets 12 is contacted with the adhesive material for forming a bond between the removable panel and the first sheet as shown in FIG. 9. The manner in which the adhesive material 52 is contacted with the first sheet 28 can vary depending upon the particular application. For example, in one embodiment, pressure can be placed on an outside surface of the removable panel 22 causing the adhesive 52 to come into contact with the first sheet 28. In one particular embodiment, for instance, as shown in FIG. 6, the removable panel 22 may be pressed with a sufficient amount of force to cause the recess to invert. Once inverted, the recess forms a protrusion facing towards an interior volume of the dispensing container 10. The adhesive material 52 is thus located on the apex of the protrusion for contact with the first sheet 28.

In the embodiment illustrated in FIG. 6, the recess 50 may be inverted during manufacture of the product or may be done by a consumer after the product has been purchased.

Figure 7:
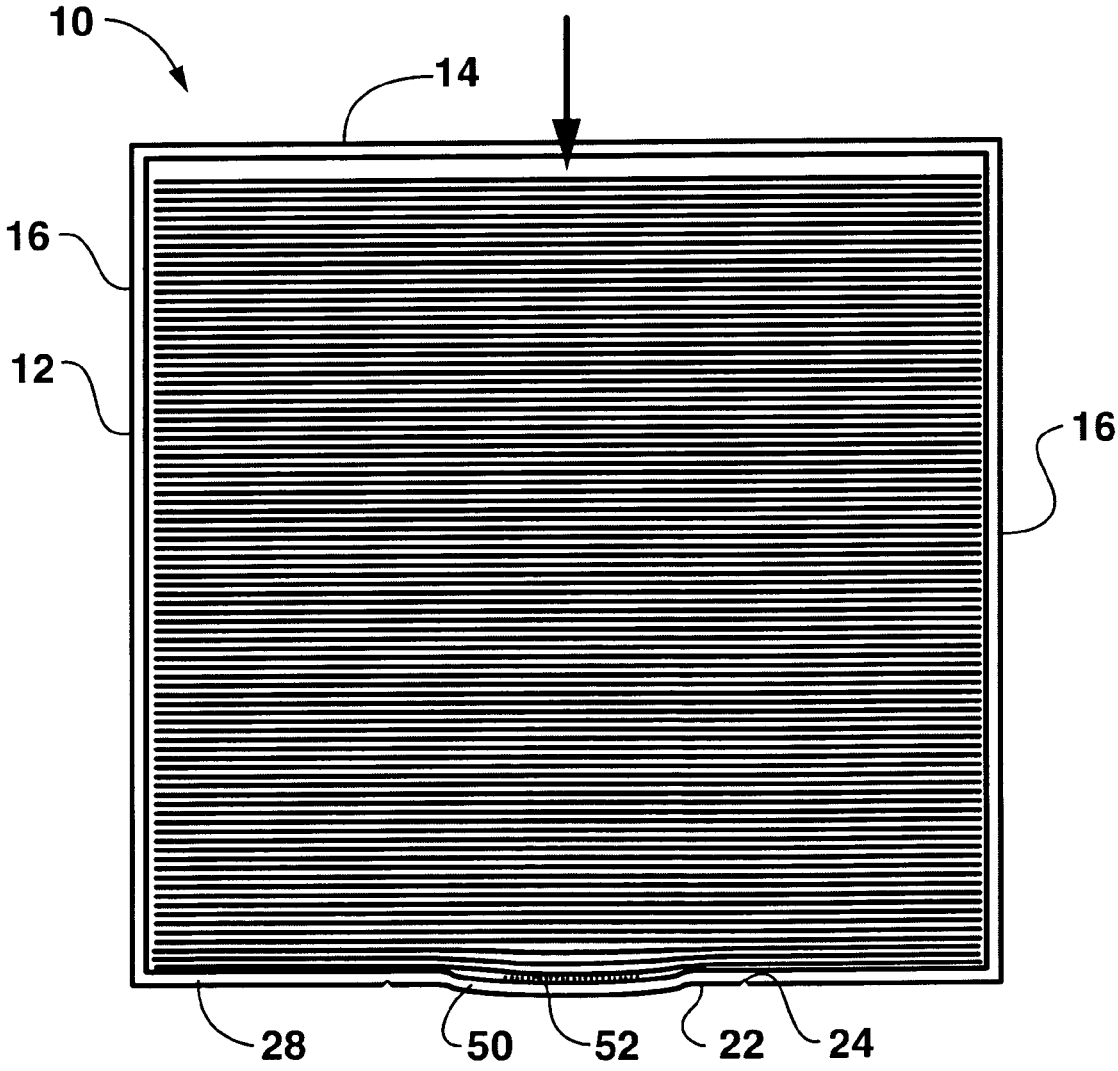
FIG. 7 is a cross-sectional view illustrating one embodiment of a method for attaching the first sheet in a stack of disposable sheets to a wall of a dispensing container in accordance with the present disclosure.

Referring to FIG. 7, another process or technique for bonding the first sheet 28 to the adhesive material 52 is illustrated. In this embodiment, the dispensing container 10 is placed in an upright configuration and loaded with a stack of disposable sheets 12. The dispensing container 10 is then inverted as shown in FIG. 7. Once inverted, the weight of the stack of disposable sheets 12 causes the first sheet 28 in the stack to contact the adhesive material 52 for forming a bond between the removable panel 22 and the first sheet 28. Once turned upright, the first sheet 28 remains bonded to the removable panel 22 as shown in FIG. 9.

The adhesive material 52 as used in the dispensing container 10 may comprise any suitable adhesive. The adhesive material, for instance, may comprise a hotmelt adhesive or a pressure sensitive adhesive. Very suitable hotmelt adhesives, for instance, are commercially available from Bostik Findley.

Pressure sensitive adhesives that may be used include the adhesive used on POST-IT Notes marketed by the 3-M Corporation of St. Paul, Minn. Such adhesives are disclosed in U.S. Pat. Nos. 5,045,569; 4,988,567; 4,994,322; 4,786,696; 4,166,152; 3,857,731; and 3,691,140, which are all incorporated herein reference. For example, the pressure sensitive adhesive can comprise polymeric microspheres having an average diameter of at least 1 micrometer. The microspheres can include about 70 parts by weight of an alkyl acrylate or alkyl methacrylate ester.

The amount of adhesive that is applied to the removable panel may also vary depending upon various factors including the type of adhesive material used and the extent to which bonding is desired between the removable panel and the disposable sheet. In some applications, for instance, only a relatively small amount of adhesive material may be needed. For example, the adhesive material may be present within the recess 50 in an amount less than 0.5 grams, such as less than about 0.1 grams. For instance, in one particular embodiment, the adhesive material may be present in the recess in an amount less than 0.05 grams, such as from about 0.01 grams to about 0.04 grams.

Various different techniques and processes may be used to form the recess 50 into the removable panel 22. For example, in one embodiment, a punching device may be brought into contact with the removable panel with a force sufficient to create an indentation. If desired, the area where the recess is to be formed may be premoistened in order to make the material more pliable, especially when the dispensing container is made from paperboard. When the dispensing container is made from a plastic material (either rigid or flexible plastic material), on the other hand, heat may be used in order to mold the recess into the removable panel.

In one particular embodiment, the recess 50 may be formed into the removable panel through an embossing process. For example, the dispensing container 10 may be fed through embossing rollers to create an embossment that defines a recess facing the interior volume of the container. Heat and/or pressure may be used during the embossing process.

In still other embodiments, the recess 50 may be created through the use of overlapping layers. For example, as described above with respect to FIG. 9, in one embodiment, overlapping the removable panel 22 with the top wall 20 may be sufficient to form a recess for purposes of the present disclosure.

Depending upon the technique used to form the recess in a removable panel, the recess can have any suitable shape. For instance, as shown in FIG. 4, the recess 50 may have a circular shape. Alternatively, however, the recess may be triangular, rectangular, or the like. In one embodiment, the recess may be in the shape of any suitable aesthetic design. Alternatively, the recess may be in the shape of a tradename or of a logo.

Figure 8:
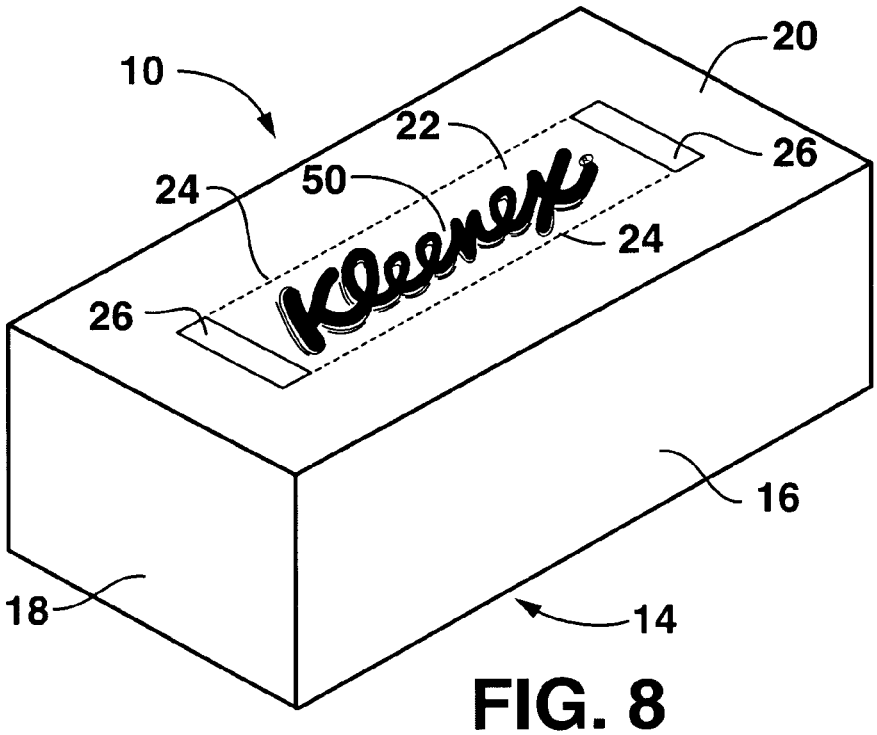
FIG. 8 is a perspective view of an alternative embodiment of a dispenser made in accordance with the present disclosure.

For example, referring to FIG. 8, another embodiment of a dispensing container 10 made in accordance with the present disclosure is shown. As illustrated, the dispensing container 10 includes a top wall 20 defining a removable panel 22. Located on the removable panel 22 is a recess 50 for receiving an adhesive material for bonding with a disposable sheet held within the dispensing container. In this embodiment, the recess 50 is in the shape of a logo, such as the word "KLEENEX®", which is a registered trademark of the assignee of the present application.

As described above, once the removable panel 22 is attached to the first sheet 28 in the stack of disposable sheets, the removable panel may be configured to either completely withdraw the first sheet 28 out of the dispensing container or may be configured to only partially remove the disposable sheet from the opening. For example, the adhesive material may be configured to release the removable panel 22 from the first sheet 28 after the sheet has been partially withdrawn from the dispensing container.

For example, referring to FIGS. 2 and 3, the dispensing container 10 is shown during and after the removable panel 22 has been pulled off the container. As shown, as the panel is removed from the container, the first sheet 28 is partially withdrawn through the opening 42. The first sheet 28 is left exposed to initiate dispensing from the container 10.

As described above, a polymer film 25 is located below the removable panel 22 in the embodiment shown in FIGS. 1-3. In accordance with the present disclosure, the polymer film may define an opening that allows the removable panel to adhere to the first sheet 28 without interfering. For example, the polymer film may define a slit that includes a hole or other cutout portion opposite where the adhesive is located.

Referring back to FIG. 9, one particular configuration of a folding system for the stack of sheets 12 in accordance with the present invention is illustrated. In this embodiment, the first sheet 28 includes a first end 46 and a second end 48. The first end of the first sheet 28 is interfolded with the second sheet 30. The second end 48 of the first sheet 28, however, is folded upon itself. For instance, in this embodiment, the second end 48 is folded upon itself twice. It should be understood, however that further or less folds can be used as desired.

In addition to being folded upon itself, the second end 48 is also connected to the removable panel 22. In this manner, when the removable panel 22 is removed from the container, the second end 48 of the first sheet 28 can be easily removed from the opening 42 without much resistance. Once the second end 48 is removed through the opening 42, however, resistance increases due to the first sheet 28 being interfolded with the second sheet 30 and/or due to the resistance of the sheet being pulled through the opening 42. This increased resistance is sufficient to release the second end 48 of the first sheet 28 from the removable panel 22, leaving the first sheet 28 partially exposed.

In the embodiment above, the removable panel is bonded to the disposable sheet in an amount necessary to pull a portion of the sheet through the opening but insufficient to overcome the force necessary to completely remove the first sheet from the container. In order to control the amount of bonding between the disposable sheet and the removable panel, a particular adhesive material may be chosen in the desired amount. In order to completely withdraw the tissue sheet through the opening, greater amounts of adhesive may be used, a different type of adhesive may be used, or a greater force may be placed between the tissue sheet and the removable panel during formation of the bond. In addition, the size and construction of the opening 42 can also be used to control the amount of force needed to either partially remove or completely remove the first sheet in the stack of disposable sheets. For example, the opening 42 can be designed to increase the resistance placed on the first sheet 28 as it is withdrawn from the container. Increasing the resistance facilitates release between the sheet and the removable panel.

Decreasing the resistance, on the other hand, may allow for the entire sheet to be withdrawn.

The present disclosure may be better understood with reference to the following examples.

Experiment 1

The following experiment was performed in order to test a method to apply an adhesive to a removable panel of a tissue dispenser during manufacture while also preventing damage to the dispenser.

First, an indentation or recess was made in the removable panel of a tissue dispenser; the indention serves as an area in which to deposit an adhesive while avoiding contacting the adhesive with any other wall of the container. The indention was made into the dispenser while the dispenser was in a blank format using a semispherical end of a hammer and a ½"-thick rubber base as an anvil. The area in which the indention was made was pre-moistened with a film of water 15 minutes before. The resulting indentation was up to ⅛" deep and 1" in diameter.

A glue gun containing Bostik Findley 998-337, a hotmelt adhesive, was used to place a bead of glue into the indentation of the removable panel. The temperature of the glue gun was 325° F., and the approximate weight and diameter of the bead was 0.03 g and ⅛" respectively. The dispenser was then assembled and loaded with a stack of tissues. The flat stack of tissues (85 2-ply sheets) was pressed to the adhesive for 10 seconds initially, and in subsequent experiments for 5 seconds with a 1000 g weight placed on top of the stack. The container was turned upright and the removable panel was peeled off.

The experiment was performed 10 times. Eight pull-outs were successful in that the top sheet was partially pulled out and the removable panel detached from the top sheet. A small tear, about ½" in diameter, was observed in the first layer of one sheet in one test. In another successful case, more adhesive was used and the whole sheet pulled out. In another test, the first sheet failed to attach to the removable panel, apparently due to the small size of the adhesive drop (between 1/16 and ⅛ in.).

Experiment 2

An indentation was made in a removable panel of a tissue container, similar to the above experiment. An amount of fiberized glue at 325° F. was sprayed into the indentation for one second at a distance of 1 inch from the removable panel. The resulting layer of glue was ½" in diameter and weighed about 0.02 g. The tissue was then pressed against the glue as above, and the removable panel was pulled off. These steps caused a successful, partial pull-out of a tissue, resulting in no tear on the sheet.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A dispenser for dispensing interfolded disposable sheets comprising:

a dispensing container housing a stack of interfolded disposable sheets that are to be withdrawn one after another, the dispensing container including a removable panel that, once removed, uncovers an opening for withdrawing the sheets, the removable panel being made from a single piece of material and including an adhesive receptive portion, the adhesive receptive portion defining a recess or a protrusion facing the stack of disposable sheets, the recess or protrusion being formed into and being integral with the removable panel, the recess or protrusion comprising an indentation or an inverted indentation that has been formed into the removable panel, an adhesive material being located on the recess or the protrusion and being attached to a first sheet in the stack of interfolded sheets.

2. A dispenser as defined in claim 1, wherein the adhesive receptive portion defines a recess.

3. A dispenser as defined in claim 1, wherein the adhesive receptive portion defines a protrusion.

4. A dispenser as defined in claim 1, wherein the recess or protrusion has a depth or length respectively of from about 0.05 inches to about 0.25 inches.

5. A dispenser as defined in claim 1, wherein the recess or protrusion has an effective diameter of from about 0.125 inches to about 0.5 inches.

6. A dispenser as defined in claim 2, wherein the adhesive material is located in the recess such that the adhesive material does not intersect a plane defined by the removable panel.

7. A dispenser as defined in claim 1, wherein the adhesive material comprises a hotmelt adhesive or a pressure sensitive adhesive.

8. A dispenser as defined in claim 1, wherein the adhesive material is present in the adhesive receptive portion in an amount less than about 0.05 grams.

9. A dispenser as defined in claim 1, wherein the adhesive receptive portion is in the shape of a tradename, a logo, or a design.

10. A dispenser as defined in claim 1, wherein, when the removable panel is removed from the dispensing container, the adhesive material pulls the first disposable sheet partially through the opening of the dispensing container and then releases without completely removing the first sheet from the container.

11. A dispenser as defined in claim 1, wherein, when the removable panel is removed from the dispensing container, the first disposable sheet remains attached to the removable panel and is completely removed from the dispensing container through the opening.

12. A dispenser as defined in claim 1, wherein the stack of interfolded disposable sheets comprise facial tissues.

13. A dispenser as defined in claim 1, wherein the removable panel is surrounded by perforations that attach the panel to the dispensing container.

14. A dispenser as defined in claim 1, wherein the dispensing container is made from paperboard.

15. A dispenser as defined in claim 1, wherein the removable panel defines a plurality of recesses, the adhesive material being located in the plurality of recesses and being attached to the first sheet at a plurality of locations.

16. A method for producing a product for dispensing interfolded disposable sheets comprising:

providing a dispensing container defining at least a first container wall and a second container wall, the first wall including a removable panel made from a single piece of material, the dispensing container having a flat sleeve configuration in which the first wall is placed adjacent the second wall and an upright configuration in which the container defines an interior volume sufficient to house a plurality of disposable sheets;

forming a recess into the removable panel, the recess facing towards the second wall when the dispensing container is in the flat configuration, the recess comprising an indentation formed into the removable panel and being integral with the removable panel;

locating an adhesive material in the recess, the recess having a depth sufficient so that the adhesive material does not contact the second wall when the dispensing container is in the flat sleeve configuration;

placing the dispensing container in the upright configuration and inserting a stack of interfolded disposable sheets into the interior volume; and contacting the adhesive material in the recess with a first sheet in the stack of interfolded disposable sheets for attaching the removable panel to the first sheet.

17. A method as defined in claim 16, wherein the adhesive material is contacted with the first sheet in the stack of interfolded disposable sheets by applying pressure to an outside surface of the removable panel.

18. A method as defined in claim 17, wherein after applying pressure to the outside surface of the removable panel, the recess is inverted forming a protrusion.

19. A method as defined in claim 16, wherein the first wall comprises a top surface of the dispensing container and the adhesive material is contacted with the first sheet of the stack of interfolded disposable sheets by turning the dispensing container upside down.

20. A method as defined in claim 16, wherein the recess has a depth of from about 0.05 inches to about 0.25 inches.

21. A method as defined in claim 16, wherein the recess has an effective diameter of from about 0.125 inches to about 0.5 inches.

22. A method as defined in claim 16, wherein the adhesive material comprises a hotmelt adhesive or a pressure sensitive adhesive.

23. A method as defined in claim 16, wherein the adhesive materials are present in the recess in an amount less than about 0.05 grams.

24. A method as defined in claim 16, wherein the adhesive receptive portion is in the shape of a tradename, a logo, or a design.

25. A method as defined in claim 16, wherein, when the removable panel is removed from the dispensing container, the adhesive material pulls the first disposable sheet partially through the opening of the dispensing container and then releases without completely removing the first sheet from the container.

26. A method as defined in claim 16, wherein, when the removable panel is removed from the dispensing container, the first disposable sheet remains attached to the removable panel and is completely removed from the dispensing container through the opening.

27. A dispensing container for dispensing disposable sheets comprising:

a one-piece blank capable of being folded into a container defining an interior volume sufficient to house a plurality of disposable sheets, the one-piece blank being made from a material comprising a paperboard, the one-piece blank defining at least one recess, the recess comprising an indentation that has been formed into the one-piece blank, an adhesive material being located in the recess and being configured to later be attached to a first sheet in a stack of disposable sheets, the recess having a depth sufficient to prevent the adhesive material from contacting an adjacent surface.

28. A dispensing container as defined in claim 27, wherein the recess has a depth of from about 0.05 inches to about 0.25 inches.

29. A dispensing container as defined in claim 27, wherein the adhesive material comprises a hotmelt adhesive or a pressure sensitive adhesive.

30. A dispensing container as defined in claim 27, wherein the adhesive material is present in the recess in an amount less than about 0.05 grams.

* * * * *